US007153413B2

(12) United States Patent
Roberie et al.

(10) Patent No.: US 7,153,413 B2
(45) Date of Patent: Dec. 26, 2006

(54) GASOLINE SULFUR REDUCTION IN FLUID CATALYTIC CRACKING

(75) Inventors: Terry G. Roberie, Ellicott City, MD (US); Ranjit Kumar, Clarksville, MD (US); Michael S Ziebarth, Columbia, MD (US); Wu-Cheng Cheng, Ellicott City, MD (US); Xinjin Zhao, Woodbine, MD (US); Nazeer Bhore, Gaithersburg, MD (US)

(73) Assignee: W.R. Grace &Co.-Conn., Columbia, MD (US)

( * ) Notice: Subject to any disclaimer, the term of this patent is extended or adjusted under 35 U.S.C. 154(b) by 821 days.

(21) Appl. No.: 09/901,939

(22) Filed: Jul. 10, 2001

(65) Prior Publication Data

US 2004/0099573 A1 May 27, 2004

(51) Int. Cl.
*C10G 11/18* (2006.01)

(52) U.S. Cl. ..... 208/113; 208/120.01; 208/120.2

(58) Field of Classification Search ..... 208/120.2, 208/113, 120.01
See application file for complete search history.

(56) References Cited

U.S. PATENT DOCUMENTS

| | | | | |
|---|---|---|---|---|
| 3,293,192 | A | 12/1966 | Maher et al. | 252/430 |
| 3,402,996 | A | 9/1968 | Maher et al. | 23/112 |
| 3,607,043 | A | 9/1971 | McDaniel et al. | 23/111 |
| 3,676,368 | A | 7/1972 | Scherzer et al. | 252/455 Z |
| 3,977,963 | A | 8/1976 | Readal et al. | 208/120 |
| 4,489,169 | A | 12/1984 | Bertus et al. | 502/64 |
| 4,642,177 | A | 2/1987 | Mester et al. | 208/113 |
| 4,728,416 | A * | 3/1988 | Myers, deceased | 208/120.2 |
| 4,790,982 | A | 12/1988 | Yoo et al. | 423/239 |
| 4,846,960 | A | 7/1989 | Walker et al. | 208/119 |
| 4,943,366 | A | 7/1990 | Fischer et al. | 208/68 |
| 4,957,718 | A | 9/1990 | Yoo et al. | 423/244 |
| 4,957,892 | A | 9/1990 | Yoo et al. | 502/63 |
| 4,963,520 | A | 10/1990 | Yoo et al. | 502/64 |
| 5,098,684 | A | 3/1992 | Kresge et al. | 423/277 |
| 5,102,643 | A | 4/1992 | Kresge et al. | 423/328 |
| 5,198,203 | A | 3/1993 | Kresge et al. | 423/718 |
| 5,376,608 | A | 12/1994 | Wormsbecher et al. | 502/61 |
| 5,399,327 | A | 3/1995 | Kim | 423/244.11 |
| 5,407,878 | A | 4/1995 | Kim | 502/41 |
| 5,525,210 | A | 6/1996 | Wormsbecher et al. | 208/122 |
| 5,547,564 | A | 8/1996 | Cheng et al. | 208/122 |
| 5,618,406 | A | 4/1997 | Demmel | 208/48 R |
| 6,036,847 | A | 3/2000 | Ziebarth et al. | 208/113 |

* cited by examiner

*Primary Examiner*—Tam M. Nguyen
(74) *Attorney, Agent, or Firm*—Beverly J. Artale; Charles A. Cross

(57) ABSTRACT

The sulfur content of liquid cracking products, especially the cracked gasoline, is reduced in a catalytic cracking process employing a cracking catalyst containing a high content of vanadium. The cracking process involves introducing at least one vanadium compound into a hydrocarbon-sulfur containing feedstock to be charged to a fluid catalytic cracking reactor operating under steady state conditions and containing an equilibrium fluid cracking catalyst inventory within the reactor. The amount of sulfur in the liquid products, in particular gasoline and LCO fractions, is reduced as a result of the increased vanadium content on the equilibrium catalyst. Advantageously, sulfur reduction is achieved even in the presence of other metal contaminants, such as nickel and iron, on the equilibrium catalyst.

13 Claims, No Drawings

GASOLINE SULFUR REDUCTION IN FLUID CATALYTIC CRACKING

CROSS-REFERENCE TO RELATED APPLICATIONS

This application is related to application Ser. No. 09/144,607, filed Aug. 31, 1998.

This application is also related to application Ser. Nos. 09/221,539 and 09/221,540, both filed Dec. 28, 1998.

This application is also related to application Ser. No. 09/399,637, filed Sep. 9, 1999.

This application also relates to application Ser. No. 09/649,627, filed Aug. 28, 2000.

FIELD OF THE INVENTION

This invention relates to the reduction of sulfur in gasoline and other petroleum products produced by a catalytic cracking process. In particular, this invention relates to an improved catalytic cracking process, which provides catalytic cracked product streams of light and heavy gasoline fractions having a reduced sulfur content.

BACKGROUND OF THE INVENTION

Catalytic cracking is a petroleum refining process which is applied commercially on a very large scale, especially in the United States where the majority of the refinery gasoline blending pool is produced by catalytic cracking, with almost all of this coming from the fluid catalytic cracking (FCC) process. In the catalytic cracking process, hydrocarbon feedstocks containing heavy hydrocarbon fractions are cracked in a FCC reactor or unit to form lighter products. Cracking is accomplished by reactions taking place at elevated temperature in the presence of a catalyst, with the majority of the conversion or cracking occurring in the vapor phase. The feedstock is thereby converted into gasoline, distillate and other liquid cracking products as well as lighter gaseous cracking products of four or less carbon atoms per molecule. The gas partly consists of olefins and partly of saturated hydrocarbons.

During the cracking reactions some heavy material, known as coke, is deposited onto the catalyst. This reduces its catalytic activity and regeneration is desired. After removal of occluded hydrocarbons from the spent cracking catalyst, regeneration is accomplished by burning off the coke to restore catalyst activity. The three characteristic steps of the catalytic cracking can therefore be distinguished: a cracking step in which the hydrocarbons are converted into lighter products, a stripping step to remove hydrocarbons adsorbed on the catalyst and a regeneration step to burn off coke from the catalyst. The regenerated catalyst is then reused in the cracking step.

Catalytic cracking feedstocks normally contain sulfur in the form of organic sulfur compounds such as mercaptans, sulfides and thiophenes. The products of the cracking process correspondingly tend to contain sulfur impurities even though about half of the sulfur is converted to hydrogen sulfide during the cracking process, mainly by catalytic decomposition of non-thiophenic sulfur compounds. The distribution of sulfur in the cracking products is dependent on a number of factors including feed, catalyst type, additives present, conversion and other operating conditions but, in any event a certain proportion of the sulfur tends to enter the light or heavy gasoline fractions and passes over into the product pool. With increasing environmental regulation being applied to petroleum products, for example in the Reformulated Gasoline (RFG) regulations, the sulfur content of the products has generally been decreased in response to concerns about the emissions of sulfur oxides and other sulfur compounds into the air following combustion processes.

One approach has been to remove the sulfur from the FCC feed by hydrotreating before cracking is initiated. While highly effective, this approach tends to be expensive in terms of the capital cost of the equipment as well as operationally since hydrogen consumption is high. Another approach has been to remove the sulfur from the cracked products by hydrotreating. Again, while effective, this solution has the drawback that valuable product octane may be lost when the high octane olefins are saturated.

From the economic point of view, it would be desirable to achieve sulfur removal in the cracking process itself since this would effectively desulfurize the major component of the gasoline blending pool without additional treatment. Various catalytic materials have been developed for the removal of sulfur during the FCC process cycle. For example, a FCC catalyst impregnated with vanadium and nickel metal has been shown to reduce the level of product (See Mystrad et al, *Effect of Nickel and Vanadium on Sulfur Reduction of FCC Naphtha*, Applied Catalyst A: General 192(2000) pages 299–305). This reference also showed that a sulfur reduction additive based on a zinc impregnated alumina is effective to reduce product sulfur in FCC products. However, when mixed with a metal impregnated catalyst, the effect of the additive to reduce sulfur was inhibited.

Other developments for reducing product sulfur have centered on the removal of sulfur from the regenerator stack gases. An early approach developed by Chevron used alumina compounds as additives to the inventory of cracking catalyst to adsorb sulfur oxides in the FCC regenerator; the adsorbed sulfur compounds which entered the process in the feed were released as hydrogen sulfide during the cracking portion of the cycle and passed to the product recovery section of the unit where they were removed. See Krishna et al, *Additives Improve FCC Process*, Hydrocarbon Processing, November 1991, pages 59–66. The sulfur is removed from stack gases emitted from the regenerator but product sulfur levels are not greatly affected, if at all.

An alternative technology for the removal of sulfur oxides from regenerator stack gases is based on the use of magnesium-aluminum spinels as additives to the circulating catalyst inventory in the FCCU. Under the designation DESOX™ used for the additives in this process, the technology has achieved a notable commercial success. Exemplary patents disclosing this type of sulfur removal additives include U.S. Pat. Nos. 4,963,520; 4,957,892; 4,957,718; 4,790,982 and others. Again, however, product sulfur levels are not greatly reduced.

Catalyst additives for the reduction of sulfur levels in the liquid cracking products was proposed by Ziebarth et al. in U.S. Pat. No. 6,036,847, using compositions containing a titania component, and Wormsbecher and Kim in U.S. Pat. Nos. 5,376,608 and 5,525,210, using a cracking catalyst additive of an alumina-supported Lewis acid for the production of reduced-sulfur gasoline but this system has not achieved significant commercial success.

In application Ser. No. 09/144,607, filed Aug. 31, 1998, catalytic materials are described for use in the catalytic cracking process, which are capable of reducing the content of the liquid products of the cracking process. These sulfur reduction catalysts comprise, in addition to a porous molecular sieve component, a metal in an oxidation state above zero within the interior of the pore structure of the sieve. The molecular sieve is in most cases a zeolite and it may be a zeolite having characteristics consistent with the large pore zeolites such as zeolite beta or zeolite USY or with the intermediate pore size zeolites such as ZSM-5. Non-zeolitic molecular sieves such as MeAPO-5, MeAPSO-5, as well as the mesoporous crystalline materials such as MCM-41 may be used as the sieve component of the catalyst. Metals such as vanadium, zinc, iron, cobalt, and gallium were found to be effective for the reduction of sulfur in the gasoline, with vanadium being the preferred metal. The amount of the metal component in the sulfur reduction additive catalyst is normally from 0.2 to 5 weight percent, but amounts up to 10 weight percent were stated to give some sulfur removal effect. The sulfur reduction component may be a separate particle additive or part of an integrated cracking/sulfur reduction catalyst. When used as a separate particle additive catalyst, these materials are used in combination with an active catalytic cracking catalyst (normally a faujasite such as zeolite Y and REY, especially as zeolite USY and REUSY) to process hydrocarbon feedstocks in the FCC unit to produce low-sulfur products.

In application Ser. Nos. 09/221,539 and 09/221,540, both filed Dec. 28, 1998, sulfur reduction catalyst similar to the one described in application Ser. No. 09/144,607 were described, however, the catalyst compositions in those applications also comprise at least one rare earth metal component (e.g. lanthanum) and a cerium component, respectively. The amount of the metal component in the sulfur reduction catalysts is normally from 0.2 to 5 weight percent, but amounts up to 10 weight percent were suggested to give some sulfur removal effect.

In application Ser. No. 09/399,637, filed Sep. 20, 1999, an improved catalytic cracking process for reducing the sulfur content of the liquid cracking products, especially cracked gasoline, produced from hydrocarbon feed containing organosulfur compounds is described. The process employs a catalyst system having a sulfur reduction component containing porous catalyst and a metal component in an oxidation state greater than zero. The sulfur reduction activity of the catalyst system is increased by increasing the average oxidation state of the metal component by an oxidation step following conventional catalyst regeneration.

Application Ser. No. 09/649,627, filed Aug. 28, 2000, is a continuation in part of application Ser. No. 09/399,637 and discloses improved sulfur reduction additives for use in a catalytic cracking process for reduction of sulfur content. The sulfur reduction additive comprises a non-molecular sieve support material (preferably an inorganic oxide support such as $Al_2O_3$, $SiO_2$, and mixtures thereof) containing a high concentration of vanadium. The amount of vanadium contained in the sulfur reduction additive catalyst is normally from about 2.0 to about 20 weight percent, typically from about 3 to about 10 weight percent (metal based on the total weight of the additive).

Despite recent sulfur reduction technologies, there continues to exist a need for effective ways to reduce the sulfur content of gasoline and other liquid cracking products. The present invention was developed in response to this need.

SUMMARY OF THE INVENTION

An improved catalytic cracking process has now been developed which is capable of improving the reduction in the sulfur content of the products of the cracking process, including the gasoline and middle distillate cracking fractions. In accordance with the process of the invention at least one vanadium containing compound is added to a liquid hydrocarbon feedstock containing sulfur, and optionally, vanadium and/or nickel, as impurities to selectively increase the concentration of vanadium in the feedstock. The vanadium-enriched feedstock is thereafter charged into a FCC unit operating under steady state conditions to contact an inventory of FCC equilibrium catalyst in situ with a high concentration of vanadium, expressed as elemental vanadium.

The mechanism by which the present invention acts to enhance the removal of sulfur components normally present in cracked hydrocarbon products is not precisely understood. However, the presence of high concentration of a vanadium compound in the feedstock enables the rapid transportation of vanadium over the entire circulating catalyst inventory, thereby increasing the activity of the cracking catalyst to remove sulfur.

Accordingly, it is an advantage of the present invention to provide an improved catalytic cracking process, which provides liquid products having improved sulfur reduction when compared to the sulfur reduction activity typical in conventional catalyst cracking processes.

It is also an advantage of the present invention to provide a catalytic cracking process which allows for the rapid dispersion of vanadium over the entire cracking catalyst inventory, thereby enhancing the removal of sulfur components from cracked hydrocarbon products.

An additional advantage of the present invention is to provide a catalytic cracking process having improved product sulfur reduction without the need for the addition of sulfur reduction additives, including zeolite/vanadium additives as disclosed in related application Ser. Nos. 09/144,607; 09/221,539; 09/221,540; 09/399,637 and 09/649,627.

Another advantage of the present invention is to provide catalytic cracking compositions in situ during a catalytic cracking process which compositions are capable of improving the reduction in the sulfur content of liquid cracking products in the presence of metal contaminants, e.g. nickel and iron.

Other objects and advantages will become apparent from the detailed description and the appended claims.

DETAIL DESCRIPTION OF THE INVENTION

For purposes of this invention the term "fresh catalyst" is used to indicate a catalyst composition as manufactured and sold.

The term "equilibrium catalyst" or "ecat" is used herein to indicate the inventory of circulating fluid cracking catalyst composition in an FCC unit operating under catalytic cracking conditions. For purpose of this invention the terms "equilibrium catalyst", "spent catalyst" (catalyst taken from an FCC unit) and "regenerated catalyst" (catalyst leaving a regeneration unit) shall be deemed equivalent.

The term "steady state" is used herein to indicate operating conditions within a FCC reactor unit wherein there exists within the unit a constant amount of catalyst inventory having a constant catalyst activity at a constant rate of feed of a feedstock having a defined composition to obtain a constant conversion rate of products.

The term "conversion rate" is used herein to indicate the rate at which a hydrocarbon feedstock is converted to lower molecular weight, lower boiling hydrocarbon products.

The term "catalyst activity" is used herein to indicate the quantity of cracked product formed per unit time per unit volume of reactor.

In accordance with the present invention, a conventional FCC process is modified to provide a high concentration of vanadium (expressed as elemental vanadium) directly onto the equilibrium catalyst inventory to reduce the sulfur content of cracked liquid products. The process involves charging a hydrocarbon feedstock, containing at least one organosulfur compound as an impurity, into a FCC unit operating under catalytic cracking conditions to contact the equilibrium catalyst inventory contained in the unit. During the FCC process, fresh FCC catalyst in added and equilibrium catalyst is withdrawn to create a steady state condition within the FCC reactor unit. Once a steady state environment is reached within the FCC unit, the hydrocarbon feedstock is treated to add at least one vanadium compound to feedstock. The vanadium treated feedstock is charged into the FCC unit operating under steady state condition to contact the equilibrium catalyst inventory and selectively provide a high content of vanadium, expressed as elemental vanadium, on the equilibrium catalyst. The vanadium-treated catalyst is thereafter re-circulated throughout the FCC unit in a continuous reaction/regeneration process to reduce the sulfur content of cracked liquid products fractions, in particular light and heavy gasoline fractions.

The catalytic cracking process of the invention may be conducted using any suitable catalytic cracking unit or reactor. For convenience, the invention will be described with reference to the FCC process although the present process could be used in the older moving bed type (TCC) cracking process with appropriate adjustments to suit the requirements of the process. Apart from the addition of the vanadium compound/s to the hydrocarbon feedstock and some possible changes in the product recovery section, discussed below, the manner of operating the process will remain unchanged. Thus, conventional FCC catalysts may be used, for example, zeolite based catalysts with a faujasite cracking component as described in the seminal review by Venuto and Habib, *Fluid Catalytic Cracking with Zeolite Catalysts*, Marcel Dekker, New York 1979, ISBN 0-8247-6870-1 as well as in numerous other sources such as Sadeghbeigi, *Fluid Catalytic Cracking Handbook*, Gulf Publ. Co. Houston, 1995, ISBN 0-88415-290-1.

Generally, the fluid catalytic cracking process in which the heavy hydrocarbon feedstock containing the organosulfur compounds will be cracked to lighter products takes place in a catalytic cracking reactor unit by contact of the feedstock in a cyclic catalyst recirculation cracking process with a circulating fluidizable catalytic cracking catalyst inventory consisting of particles having a size ranging from about 20 to about 100 microns. The significant steps in the cyclic process are:

(i) the hydrocarbon-containing feedstock or feed is charged into a catalytic cracking unit, normally containing one or more risers, operating at catalytic cracking conditions by contacting the feedstock with a source of hot, regenerated cracking catalyst to produce an effluent comprising cracked products and spent catalyst containing coke and strippable hydrocarbons;

(ii) the effluent is discharged and separated, normally in one or more cyclones, into a vapor phase rich in cracked product and a solids rich phase comprising the spent catalyst;

(iii) the vapor phase is removed as product and fractionated in the FCC main column and its associated side columns to form liquid cracking products including gasoline;

(iv) the spent catalyst is stripped, usually with steam, to remove occluded hydrocarbons from the catalyst, after which the stripped catalyst is oxidatively regenerated to produce hot, regenerated catalyst which is then recycled to the cracking zone for cracking further quantities of feed.

As fresh catalyst equilibrates within an FCC unit or reactor, the equilibrium catalyst is exposed to various conditions, such as the deposition of feedstock contaminants and the severe regeneration of operation conditions. Thus, equilibrium catalyst may contain high levels of metal contaminants, including but not limited to, vanadium, nickel and iron. In normal operation of a FCC unit, fresh catalyst is added daily at the same rate that equilibrium catalyst is withdrawn. This provides a constant amount of catalyst inventory having a constant catalyst activity, which maintains a constant conversion of feed and selectivity of desired products.

Thus, at steady state operation conditions, the amount of equilibrium catalyst in the FCC unit is constant, i.e. the amount of fresh catalyst added to the FCC unit is equal to the amount of equilibrium catalyst withdrawn from the unit plus the amount of equilibrium catalyst lost due to attrition. Also, during steady state operation of a FCC unit, the rate at which a feedstock having a defined composition is added to the unit is held constant. This feed can be characterized by a number of properties such as API gravity, specific gravity, total sulfur (wt %), total nitrogen (wt %), metals content (wt %), Conradson carbon, K factor, and boiling point and molecular weight distributions.

Typically, during the cracking reaction in the FCC unit, the sulfur in the feed becomes distributed in the liquid and gaseous fractions of the cracked products. These products include $H_2S$ gasoline, light cycle oil (LCO), heavy cycle oil (HCO), coke and unconverted feed. Under steady state conditions, the amount of sulfur (on a wt % basis) generated in these products is constant. Unexpectedly, however, it has been found that the addition of vanadium from a secondary source to the feed being charged into a FCC unit operating under a steady state environment selectively increases the concentration of vanadium on the equilibrium catalyst circulating inventory to effectively reduce the sulfur content of the cracked products. The amount of sulfur in the liquid products, especially the gasoline fractions, is lowered as a result of the increased vanadium on the equilibrium catalyst, even in the presence of metal contaminants such as nickel and iron.

Accordingly, the process in accordance with the present invention generally comprises (i) providing a substantially liquid heavy hydrocarbon feed stream comprising at least one organosulfur compound as an impurity;

(ii) charging the hydrocarbon feed stream into a FCC reactor unit operating under catalytic cracking conditions and having a circulating inventory of an equilibrium catalyst composition;

(iii) removing a portion of the equilibrium catalyst inventory from the FCC reactor unit while replacing all removed equilibrium catalyst inventory with fresh catalyst to create a steady state environment within the unit;

(iv) contacting the hydrocarbon feed stream with at least one vanadium compound in an amount sufficient to increase the concentration of vanadium in or on the equilibrium catalyst inventory by about 100 to about 20,000 ppm, relative to the amount of vanadium initially present in or on the catalyst inventory; and (v) contacting the vanadium containing hydrocarbon feed stream with the equilibrium catalyst inventory in the FCC reactor unit under steady state conditions to produce a cracking zone effluent comprising cracked products having a reduced sulfur content.

Vanadium compounds useful in the present invention may be any vanadium containing compound which permits the transport and deposition of the vanadium species to the cracking catalyst under catalytic cracking conditions. Non-limiting examples of suitable vanadium compounds are ammonium ortho-, pyro- or meta vanadates, vanadium oxides (e.g. $V_2O_5$), vanadic acids, organometallic vanadium complexes (e.g. vanadyl naphenate), vanadium sulfate, vanadium nitrate, vanadyl nitrate, vanadium halides and oxyhalides (e.g. vanadium chlorides and oxychlorides) and mixtures thereof. Preferably, the vanadium compound is selected from the group consisting of vanadium oxalate, vanadium sulfate, vanadium naphthenate, vanadium halides, and mixtures thereof.

In a preferred embodiment, the vanadium compound/s are blended into the feed as a solution prior to injection of the feed into the reactor. Suitable vanadium solutions include those solutions wherein the desired vanadium compound/s are dissolved in water or a non-aqueous solvent, e.g. a suitable organic solvent such as pentane, toluene and the like. In a preferred embodiment, a non-aqueous vanadium napthenate solution is used.

The amount of the vanadium solution added to the feed stream will typically be relatively small. Consequently, the vanadium solution can be added to the feedstock using any commercially available pump. For practical application, the delivery of the vanadium solution may be continuous or intermittent.

The cracking catalyst used in the cracking process of the invention will normally be based on a faujasite zeolite active cracking component, which is conventionally zeolite Y in one of its forms such as calcined rare-earth exchanged type Y zeolite (CREY), the preparation of which is disclosed in U.S. Pat. No. 3,402,996, ultrastable type Y zeolite (USY) as disclosed in U.S. Pat. No. 3,293,192, as well as various partially exchanged type Y zeolites as disclosed in U.S. Pat. Nos. 3,607,043 and 3,676,368. The active cracking component is routinely combined with a matrix material such as alumina in order to provide the desired mechanical characteristics (attrition resistance etc.) as well as activity control for the very active zeolite component or components. The particle size of the cracking catalyst is typically in the range of 10 to 120 microns for effective fluidization.

The feedstocks useful in the catalytic cracking process of this invention include a liquid or substantially liquid hydrocarbon feed containing sulfur as a contaminant. The feedstocks include those which are conventionally utilized in catalytic cracking processes to produce gasoline and light distillate fractions from heavier hydrocarbon feedstocks. The feedstocks generally have an initial boiling point above about 400° F. (204° C.) and include fluids such as gas oils, fuel oils, cycle oils, slurry oils, topped crudes, shale oils, oils from tar sands, oils from coal, mixtures of two or more of these, and the like. By "topped crude" is meant those oils which are obtained as the bottoms of a crude oil fractionator. If desired, all or a portion of the feedstock can constitute an oil from which a portion of the metal content previously has been removed, e.g., by hydrotreating or solvent extraction.

Optionally, the feedstock utilized in this process may contain as impurities one or more of the metals nickel, vanadium and iron at the following typical ranges: nickel at a level of about 0.02 to about 100 ppm; vanadium at a level of about 0.02 to 500 ppm; and iron at a level of 0.02 to 500 ppm. In a preferred embodiment, the feedstock contains vanadium as an impurity.

In accordance with the process of the invention, the vanadium compound is added to the feed during operation of the FCC unit under steady state conditions. The amount of vanadium compound added to the feed will vary depending upon such factors as the nature of the feedstock used, the cracking catalyst used and the results desired. Generally, the vanadium compound is added to the feed at a rate sufficient to increase the concentration of vanadium in or on the equilibrium catalyst inventory by about 100 to about 20,000 ppm, preferably about 300 to about 5000 ppm, most preferably about 500 to about 2000 ppm, relative to the amount of vanadium initially present in or on the catalyst inventory.

The concentration of vanadium on the equilibrium catalyst inventory under state steady conditions can be determined by the following equation:

$$\text{ppm V on ecat} = \frac{\text{ppm V in feed} \times \text{feed rate(Tons/Day)}}{\text{Catalyst Addition Rate(T/D)}}$$

The catalytic cracking process of the invention is conducted in conventional FCC reactor units wherein the reaction temperature ranges from about 400° C. to 700° C. and regeneration temperatures from about 500° C. to 850° C. are utilized. Conditions within the cracking and regeneration zone, as will be understood by the skilled artisan, are not critical and depend upon several parameters, such as the feed stock used, the catalyst, and the results desired.

The effect of the improved process of the invention is to reduce the sulfur content of the liquid cracking products, especially the light gasoline fractions although reductions are also noted in the light cycle oil, making the products more suitable for use as a diesel or home heating oil blend component. Gasoline sulfur reduction of 25% or more is readily achievable using the process according to the present invention, as shown by the Examples below. The sulfur removed by the use of the process is converted to the inorganic form and released as hydrogen sulfide which can be recovered in the normal way in the product recovery section of the FCC unit. The increased load of hydrogen sulfide may impose additional sour gas/water treatment requirements but with the significant reductions in gasoline sulfur achieved, these are not likely to be considered limitative.

To further illustrate the present invention and the advantages thereof, the following specific examples are given. The examples are given as specific illustrations of the claim invention. It should be understood, however, that the invention is not limited to the specific details set forth in the examples.

All parts and percentages in the examples as well as the remainder of the specification are by weight unless otherwise specified.

Further, any range of numbers recited in the specification or claims, such as that representing a particular set of properties, units of measure, conditions, physical states or percentages, is intended to literally incorporate expressly herein by reference or otherwise, any number falling within such range, including any subset of numbers within any range so recited.

EXAMPLES

Example 1

Catalytic Evaluation of Vanadium Added to Feed

The process of the invention was tested in the Davision circulation riser (DCR) for catalytic performance for gasoline sulfur reduction. A gas oil feed with about 1.04 wt % of sulfur in feed was used as the base feed. The feed properties are shown in Table 1.

TABLE 1

| Feed Properties Heavy Vacuum Gas Oil | |
|---|---|
| API Gravity @60° F. | 25.3 |
| Specific Gravity @60° F. | 0.9023 |
| Aniline Point, ° F. | 178 |
| Sulfur, wt. % | 1.041 |
| Total Nitrogen, wt. % | 0.07 |
| Basic Nitrogen, wt. % | 0.0308 |
| Conradson Carbon, wt. % | 0.21 |
| Ni, ppm | 0.2 |
| V, ppm | 0.4 |
| Fe, ppm | 3.7 |
| Na, ppm | 0 |
| Cu, ppm | 0 |
| K Factor | 11.67 |
| Refractive Index | 1.501736 |
| Average Molecular Weight | 348 |
| % Paraffinic Ring Carbons, $C_p$ | 59.8 |
| % Naphthenic Ring Carbons, $C_n$ | 21.1 |
| % Aromatic Ring Carbons, $C_a$ | 19 |
| Simulated Distillation, vol. %, ° F. | |
| IBP | 309 |
| 5 | 462 |
| 10 | 525 |
| 20 | 601 |
| 30 | 653 |
| 40 | 703 |
| 50 | 748 |
| 60 | 792 |
| 70 | 835 |
| 80 | 885 |
| 90 | 941 |
| 95 | 981 |
| FBP | 1063 |
| Percent Recovery | 100 |

2.50 grams of a vanadium naphthenate solution containing about 3 wt % of vanadium was blended with 3000 grams of the feed. The resulting feed contained about 25 ppm of vanadium as analyzed by ICP and a vanadium to nickel ratio of 125.

A commercial FCC catalyst was used for the study. The catalyst was steamed deactivated for 4 hours at 1500° F. in 100% steam. The catalyst properties are shown in Table 2.

TABLE 2

| Catalyst Properties | |
|---|---|
| Chemical Analyses (Fresh) | |
| $Al_2O_3$ | 57.4 wt. % |
| $SiO_2$ | 37.9 wt. % |
| $RE_2O_3$ | 2.05 wt. % |
| $Na_2O$ | 0.30 wt. % |
| $SO_4$ | 1.18 wt. % |
| $TiO_2$ | 0.99 wt. % |
| $Fe_2O_3$ | 0.64 wt. % |
| $P_2O_5$ | 0.14 wt. % |
| CaO | 0.09 wt. % |
| MgO | 0.05 wt. % |

TABLE 2-continued

| Catalyst Properties | |
|---|---|
| Physical Properties (3 hrs./1000° F.) | |
| BET Surface Area | 259 $m^2/g$ |
| Zeolite Area | 147 $m^2/g$ |
| Matrix Area | 112 $m^2/g$ |
| Unit Cell Size | 24.56 (Å) |
| Steam Deactivation (4 hr/1500° F./100% steam) | |
| BET Surface Area | 141 $m^2/g$ |
| Zeolite Area | 65 $m^2/g$ |
| Matrix Area | 76 $m^2/g$ |
| Unit Cell Size | 24.36 (Å) |

The catalyst and feed combinations were tested for cracking activity and selectivity as well as gasoline sulfur effect in the DCR. The liquid product from each run was analyzed for sulfur using a gas chromatograph with an Atomic Emission Detector (GC-AED). Analysis of the liquid products with the GC-AED allowed each of the sulfur species in the gasoline region to be quantified. For purposes of this example, the cut gasoline will be defined as $C_5$ to $C_{12}$ hydrocarbons that have a boiling point up to 430° F. The sulfur species included in the cut of gasoline range include thiophene, tetrahydrothiophene, $C_1$–$C_5$ alkylated thiophenes and a variety of aliphatic sulfur species. Benzothiophene is not included in the cut gasoline range.

The DCR data for the catalysts is shown in Table 3 below.

TABLE 3

| Effect of Feed Added V on Gasoline Sulfur | | | | |
|---|---|---|---|---|
| Vanadium, ppm | 0 | 360 | 773 | 1250 |
| Conversion, wt % | 77.06 | 76.49 | 74.68 | 76.32 |
| Kinetic Conv | 3.36 | 3.25 | 2.95 | 3.22 |
| C/O Ratio | 8.10 | 8.31 | 8.73 | 8.54 |
| $H_2$ Yield, wt % | 0.02 | 0.03 | 0.06 | 0.06 |
| $C_1 + C_2$'s ,wt % | 1.65 | 1.69 | 1.70 | 1.70 |
| Total $C_3$, wt % | 5.67 | 5.66 | 5.27 | 5.42 |
| Total $C_4$, wt % | 10.52 | 10.71 | 10.06 | 10.50 |
| Gasoline, wt % | 54.22 | 53.24 | 52.19 | 53.41 |
| LCO, wt % | 18.21 | 18.51 | 19.52 | 18.81 |
| Bottoms, wt % | 4.74 | 5.00 | 5.80 | 4.87 |
| Coke, wt % | 4.51 | 4.66 | 4.92 | 4.74 |
| Cut Gasoline Sulfur, ppm | 610 | 500 | 393 | 412 |
| Percent Gasoline S Reduction Relative to 0 ppmV | | 18.0% | 35.5% | 32.4% |

The first column shows the FCC catalyst without the addition of vanadium to the feed. The next three columns show the product yields and gasoline sulfur as the vanadium accumulated on the catalyst at about 360 ppm, 773 ppm, and 1250 ppm. The data shows that the added vanadium decreased cut gasoline range sulfur content from 18 to 35% as compared to the base FCC catalyst. The H2 increased modestly as the vanadium increased but the effect on coke was small.

Example 2

Catalytic Evaluation of Vanadium Added to Feed

This example shows the effect of feed vanadium gasoline in the DCR. A commercial equilibrium FCC catalyst and a commercial FCC gas oil feed with about 0.05 wt % of S was used. The equilibrium catalyst contained 24 ppm Ni and 110 ppm V. The catalyst properties are shown in Table 4 below.

TABLE 4

| Ecat Properties | |
|---|---|
| Chemical Analyses | |
| $SiO_2$ | 64.87 wt. % |
| $Al_2O_3$ | 31.6 wt. % |
| $RE_2O_3$ | 2.69 wt. % |
| $Na_2O$ | 0.29 wt. % |
| $SO_4$ | 0.13 wt. % |
| Fe | 0.5 wt. % |
| $TiO_2$ | 1.1 wt. % |
| MgO | 0.052 wt. % |
| $P_2O_5$ | 0.271 wt. % |
| CaO | 0.086 wt. % |
| Ni | 54 ppm |
| V | 110 ppm |
| Physical Analyses (3 hrs. / 1000° F.) | |
| BET Surface Area | 181 $m^2/g$ |
| Zeolite Area | 137 $m^2/g$ |
| Matrix Area | 44 $m^2/g$ |

The feed properties are shown in Table 5 below.

TABLE 5

| Feed Properties | |
|---|---|
| API Gravity @60° F. | 22.3 |
| Specific Gravity @60° F. | 0.92 |
| Aniline Point, ° F. | 157 |
| Sulfur, wt. % | 0.055 |
| Total Nitrogen, wt. % | 0.2 |
| Basic Nitrogen, wt. % | 0.056 |
| Conradson Carbon, wt. % | 0.05 |
| Ni, ppm | 0 |
| V, ppm | 0.1 |
| Fe, ppm | 0 |
| Na, ppm | 0.6 |
| Cu, ppm | 0 |
| K Factor | 11.36 |
| Refractive Index | 1.50846 |
| Average Molecular Weight | 324 |
| % Paraffinic Ring Carbons, $C_p$ | 46.4 |
| % Naphthenic Ring Carbons, $C_n$ | 34.2 |
| % Aromatic Ring Carbons, $C_a$ | 19.4 |
| Simulated Distillation, vol. %, ° F. | |
| IBP | 264 |
| | 433 |
| | 490 |
| | 577 |
| | 635 |
| | 685 |
| | 728 |
| | 771 |
| | 814 |
| | 860 |
| | 926 |
| | 988 |
| FBP | 1415 |
| Percent Recovery | 100 |

The DCR was operated with a riser temperature of 970° F. and a regenerator temperature of 1300° F. All the liquid products were analyzed by GC-AED for gasoline sulfur levels. The DCR data for the catalysts is shown in Table 6 below.

TABLE 6

| DCR Study with Vadanium Added to Feed 970° F. Riser Temperature | Column A E-Cat | Column B E-Cat V Feed |
|---|---|---|
| Added | | |
| Total V in System, ppm | 110 | 640 |
| V on ECAT Only, ppm | 110 | 110 |
| Conversion | 68 | |
| Activity | 6.18 | 6.88 |
| $H_2$ Yield wt % | 0.03 | 0.06 |
| $C_1 + C_2$'s wt % | 1.86 | 1.87 |
| Total $C_3$ wt % | 5.06 | 4.97 |
| $C_3$ wt % | 0.69 | 0.77 |
| $C_3$ = wt % | 4.37 | 4.19 |
| Total $C_4$ wt % | 9.42 | 9.01 |
| $IC_4$ wt % | 3.05 | 3.08 |
| $nC_4$ wt % | 0.55 | 0.58 |
| Total $C_4$ = wt % | 5.82 | 5.34 |
| Gasoline wt % | 49.13 | 49.03 |
| LCO wt % | 24.90 | 24.90 |
| Bottoms wt % | 6.91 | 6.84 |
| Coke wt % | 2.33 | 2.85 |
| ppm S Gasoline | | |
| Mercaptans | 9 | 7 |
| Thiophene | 6 | 5 |
| MethylThiophenes | 21 | 18 |
| TetrahydroThiophene | 2 | 1 |
| $C_2$-Thiophenes | 17 | 13 |
| Thiophenol | 2 | 0 |
| $C_3$-Thiophenes | 7 | 2 |
| MethylThiophenol | 7 | 0 |
| $C_4$-Thiophenes | 7 | 0 |
| BenzoThiophene | 11 | 10 |
| ppm S Gasoline | | |
| Light Cut Sulfur | 45 | 38 |
| Heavy Cut Sulfur | 14 | 2 |
| Cut Gasoline Sulfur | 60 | 41 |
| Total Sulfur | 71 | 50 |
| Thiophenols | 9 | 0 |
| Total Sulfur + Thiophenols | 80 | 51 |
| % Gasoline S Reduction | | |
| Light Cut Sulfur | | 16% |
| Heavy Cut Sulfur | | 85% |
| Cut Gasoline Sulfur | | 32% |
| Total Sulfur | | 29% |
| Thiophenols | | 100% |
| Total Sulfur + Thiophenols | | 36% |

The product selectivity was interpolated to a constant conversion of 68 wt %. The first set of yield data was obtained on the base feed and base catalyst without the feed vanadium. At the end of the first set of yield data, the DCR was operated with the same feed, but added 39 grams of vanadium naphthenate solution into 3000 grams of feed. The newly made feed contained about 390 ppm vanadium. Since nickel was below the detection limit, the ratio of vanadium and nickel was not calculated. The DCR continuously operated for 3 hours and the vanadium level on the catalyst was about 750 ppm.

The Ecat data with vanadium added to the feed (Column B) showed about 32% reduction in cut gasoline sulfur as compared to the base Ecat (Column A).

Reasonable variations and modifications, which will be apparent to those skilled in the art, can be made in this invention without departing from the spirit and scope thereof.

What is claimed is:

1. A process of reducing the sulfur content of liquid cracking products from a fluid catalytic cracking (FCC) process in which a heavy hydrocarbon feed comprising organosulfur compounds is catalytically cracked to lighter products by contact in a cyclic catalyst recirculation cracking process with a circulating fluidizable catalytic cracking equilibrium catalyst inventory, the process comprising:

(i) providing a substantially liquid heavy hydrocarbon feed stream comprising at least one organosulfur compound as an impurity;

(ii) introducing the hydrocarbon feed stream into a FCC reactor unit operating under catalytic cracking conditions and comprising a circulating inventory of an equilibrium catalyst composition;

(iii) removing a portion of the equilibrium catalyst inventory from the FCC reactor unit while replacing all the equilibrium catalyst inventory removed from the unit with fresh catalyst to create a steady state environment within the FCC reactor unit;

(iv) contacting the hydrocarbon feed stream with at least one metal compound wherein the metal consists essentially of vanadium, in an amount sufficient to selectively increase the concentration of vanadium in or on the equilibrium catalyst inventory by about 100 to about 20,000 ppm, relative to the amount of vanadium initially present in or on the equilibrium catalyst inventory;

(v) contacting the equilibrium catalyst inventory in the FCC reactor unit with the vanadium containing hydrocarbon feed stream under a steady state environment to produce a cracking zone effluent comprising liquid cracked products, including gasoline, having a reduced sulfur content.

2. The process of claim 1 further comprising simultaneously producing a spent catalyst containing coke and strippable hydrocarbons in step (iii).

3. The process of claim 2 further comprising (i) discharging and separating the effluent mixture into a cracked product rich vapor phase and a solid rich phase comprising spent catalyst; and (ii) removing the vapor phase as a product and fractionating the vapor to form liquid cracking products, including gasoline, having a reduced sulfur content.

4. The process of claim 1 wherein the at least one metal compound is selected from the group consisting of ammonium ortho-pyro- or meta vanadates, hydrated vanadium oxides, vanadic acids, organometallic vanadium complexes, vanadium sulfate, vanadyl sulfate, vanadium nitrate, vanadium halides and oxyhalides and mixtures thereof.

5. The process of claim 4 wherein the at least one metal compound is selected from the group consisting of vanadium oxalate, vanadium sulfate, vanadium naphthenate, vanadium halides, and mixtures thereof.

6. The process of claim 1 wherein the hydrocarbon feed stream is contacted with the at least one metal compound in an amount sufficient to selectively increase the concentration of vanadium in or on the equilibrium catalyst inventory by about 300 to about 5000 ppm, relative to the amount of vanadium initially present in or on the cracking catalyst.

7. The process of claim 6 wherein the hydrocarbon feed stream is contacted with the at least one metal compound in an amount sufficient to selectively increase the concentration of vanadium in or on the equilibrium catalyst inventory by about 500 to about 2000 ppm, relative to the amount of vanadium initially present in or on the cracking catalyst.

8. The process of claim 1 wherein the cracking catalyst comprises a large pore size zeolite.

9. The process of claim 8 wherein the large pore size zeolite comprises a faujasite.

10. The process of claim 1 wherein the hydrocarbon feed further comprises vanadium as an impurity.

11. The process of claim 10 wherein the hydrocarbon feed further comprises nickel as an impurity.

12. An improved process for catalytic cracking of a hydrocarbon feedstock which contains at least one organic sulfur compounds comprising contacting in a fluid catalytic cracking (FCC) reactor an inventory of fluid catalytic cracking equilibrium catalyst, removing a portion of the catalyst inventory while replacing the same amount of fresh catalyst composition to provide a steady state environment within the FCC reactor, the improvement comprising;

(i) contacting the hydrocarbon feed with at least one metal compound wherein the metal consists essentially of vanadium, in an amount sufficient to selectively increase the concentration of vanadium in or on the equilibrium catalyst inventory by about 100 to about 20,000 ppm, relative to the amount of vanadium initially present in or on the equilibrium catalyst inventory;

(ii) contacting the equilibrium catalyst inventory with the vanadium containing hydrocarbon feed in a FCC reactor unit under a steady state environment to produce a cracking zone effluent comprising liquid cracked products, including gasoline, having a reduced sulfur content.

13. The process of claim 3 wherein the process further comprises the addition steps of (i) stripping the solids rich spent catalyst phase to remove occluded hydrocarbons from the catalyst, (ii) transporting stripped catalyst from the stripper to a catalyst regenerator;

(iii) regenerating stripped catalyst by contact with oxygen containing gas to produce regenerated catalyst; and (iv) recycling the regenerated catalyst to the cracking unit to contact further quantities of heavy hydrocarbon feed.

* * * * *